US006146153A

United States Patent [19]

Koradia et al.

[11] Patent Number: 6,146,153

[45] **Date of Patent: *Nov. 14, 2000**

[54] ADAPTER APPARATUS AND METHOD FOR TRANSMITTING ELECTRONIC DATA

[75] Inventors: Amir Koradia, Palatine; Philip A. Ravlin, Bartlett; John J. Connell, Lake Zurich, all of Ill.

[73] Assignee: 3Com Corporation, Rolling Meadows, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/265,000

[22] Filed: Mar. 3, 1999

[51] Int. Cl.[7] ..... H01R 12/00

[52] U.S. Cl. ..... 439/76.1; 439/638

[58] Field of Search ..... 439/76.1, 638, 439/650, 651, 652

[56] References Cited

U.S. PATENT DOCUMENTS

| | | | |
|---|---|---|---|
| 3,551,874 | 12/1970 | Volinskie | 339/17 |
| 4,585,284 | 4/1986 | Koser et al. | 339/17 |
| 5,026,293 | 6/1991 | Wilson | 439/76 |
| 5,622,506 | 4/1997 | Hornig et al. | 439/74 |
| 5,689,401 | 11/1997 | Shikano | 361/685 |

*Primary Examiner*—Lincoln Donovan
*Assistant Examiner*—Kyung S. Lee
*Attorney, Agent, or Firm*—Baniak Nicholas Pine & Gannon

[57] ABSTRACT

An adapter apparatus for transmitting electronic data includes a circuit board having a first side and a second side. At least two male connectors are positioned adjacent to the first side of the circuit board. Each of the at least two male connectors includes a plurality of transmit-receive pairs of pins. Each of the plurality of transmit-receive pairs of pins includes a pin for transmitting data and a pin for receiving data. A first pin header is positioned adjacent the second side of the circuit board. The first pin header includes a plurality of pins for receiving data. A second pin header is positioned adjacent the second side of the circuit board. The second pin header includes a plurality of pins for transmitting data. The plurality of pins for receiving data and the plurality of pins for transmitting data are operatively connected to the plurality of transmit-receive pairs of pins.

18 Claims, 2 Drawing Sheets

ADAPTER APPARATUS AND METHOD FOR TRANSMITTING ELECTRONIC DATA

FIELD OF THE INVENTION

This invention relates generally to the field of electrical connectors and in particular, to an adapter for transmitting electronic data.

BACKGROUND OF THE INVENTION

Electronic chassis which house electronic components for high-speed telecommunication and networking applications typically include a plurality of vertically oriented circuit boards. When fully inserted into the chassis, these vertically oriented circuit boards are electrically connected to another circuit board, commonly referred to as a backplane circuit board. The backplane circuit board is positioned along the backside of the electronic chassis.

The backplane circuit board is then typically connected to a data network such as, for example, a telephone network. This may be accomplished by providing an array of wire wrap pins that are electrically connected to the backplane circuit board and extend outward from the outside surface of the backplane circuit board. Electronic data is transferred to and from the backplane circuit board by connecting input wires to the array of pins. However, this arrangement results in increased manufacturing costs due to the large number of discrete components that are required. Moreover, the process of connecting all of the input wires to the array of pins is labor intensive, which also increases manufacturing costs.

Attempts have been made to provide a plurality of connectors that are mounted on the outside surface of the backplane circuit board and are electrically connected to the backplane circuit board. The connectors receive input cables, which transmit data to and from the backplane circuit board. Each of the connectors mounted on the backplane circuit board typically includes 25 pairs of pins, each pair including one pin for transmitting data and another pin for receiving data. As a result, connections to the backplane circuit board can only be made if the connectors of the input cables are compatible with the connectors mounted on the backplane circuit board. In other words, each of the connectors of the input cables must also have 25 pairs of pins, each pair including one pin for transmitting data and another pin for receiving data. Problems arise, however, if the connectors of the input cables are not compatible with the connectors mounted on the backplane circuit board. For example, an input cable may have a connector that is comprised of 50 pins that only transmit data, while another input cable may have a connector that is comprised of 50 pins that only receive data. In this scenario, there is typically no practical way to make electrical connections between the input cables and the connectors mounted on the backplane circuit board.

Accordingly, it would be desirable to have an adapter apparatus and method of transmitting data that overcomes the disadvantages described above.

SUMMARY OF THE INVENTION

One aspect of the invention provides an adapter apparatus for transmitting electronic data. A circuit board includes a first side and a second side. At least two male connectors are positioned adjacent to the first side of the circuit board. Each of the male connectors includes a plurality of transmit-receive pairs of pins. Each of the transmit-receive pairs of pins includes a pin for transmitting data and a pin for receiving data. A first pin header having a plurality of pins for receiving data is positioned adjacent the second side of the circuit board. A second pin header having a plurality of pins for transmitting data is positioned adjacent the second side of the circuit board. The plurality of pins for receiving data and the plurality of pins for transmitting data are operatively connected to the plurality of transmit-receive pairs of pins. The first and second pin headers may preferably be positioned adjacent to one another. The plurality of pins of the first pin header may preferably be aligned in a first row and a second row. Similarly, the plurality of pins of the second pin header may preferably be aligned in a first row and a second row. The first and second pin headers each may preferably include 50 pins. The plurality of transmit-receive pairs of pins of the two male connectors may preferably be comprised of 25 pairs. Each of the male connectors may preferably be a centronics connector. The circuit board may preferably include a plurality of openings to allow the adapter apparatus to be attached to a housing. The two male connectors may preferably be operatively connected to a backplane circuit board. At least two female connectors may preferably be operatively connected to a first side of the backplane circuit board, and the two male connectors may be operatively connected to the at least two female connectors. The two female connectors each may preferably include a plurality of transmit-receive pairs of pins, each of the plurality of transmit-receive pairs of pins including a pin for transmitting data and a pin for receiving data. The two male connectors may preferably be positioned adjacent to one another and the two female connectors may preferably be positioned adjacent to one another. The plurality of transmit-receive pairs of pins of the two female connectors may preferably be comprised of 25 pairs. Each of the two female connectors may preferably be a centronics connector.

Another aspect of the invention provides a method of transmitting electronic data. A circuit board including a first side and a second side is provided. At least two male connectors are positioned adjacent to the first side of the circuit board. Each of the two male connectors includes a plurality of transmit-receive pairs of pins. Each of the plurality of transmit-receive pairs of pins includes a pin for transmitting data and a pin for receiving data. A first pin header is positioned adjacent the second side of the circuit board. The first pin header includes a plurality of pins for receiving data. A second pin header is positioned adjacent the second side of the circuit board. The second pin header includes a plurality of pins for transmitting data. The plurality of pins for receiving data and the plurality of pins for transmitting data are operatively connected to the plurality of transmit-receive pairs of pins. A backplane circuit board may also be provided. At least two female connectors may preferably be operatively connected to a first side of the backplane circuit board. The two male connectors may preferably be operatively connected to the two female connectors.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PRESENTLY PREFERRED EMBODIMENTS

Figure 1:
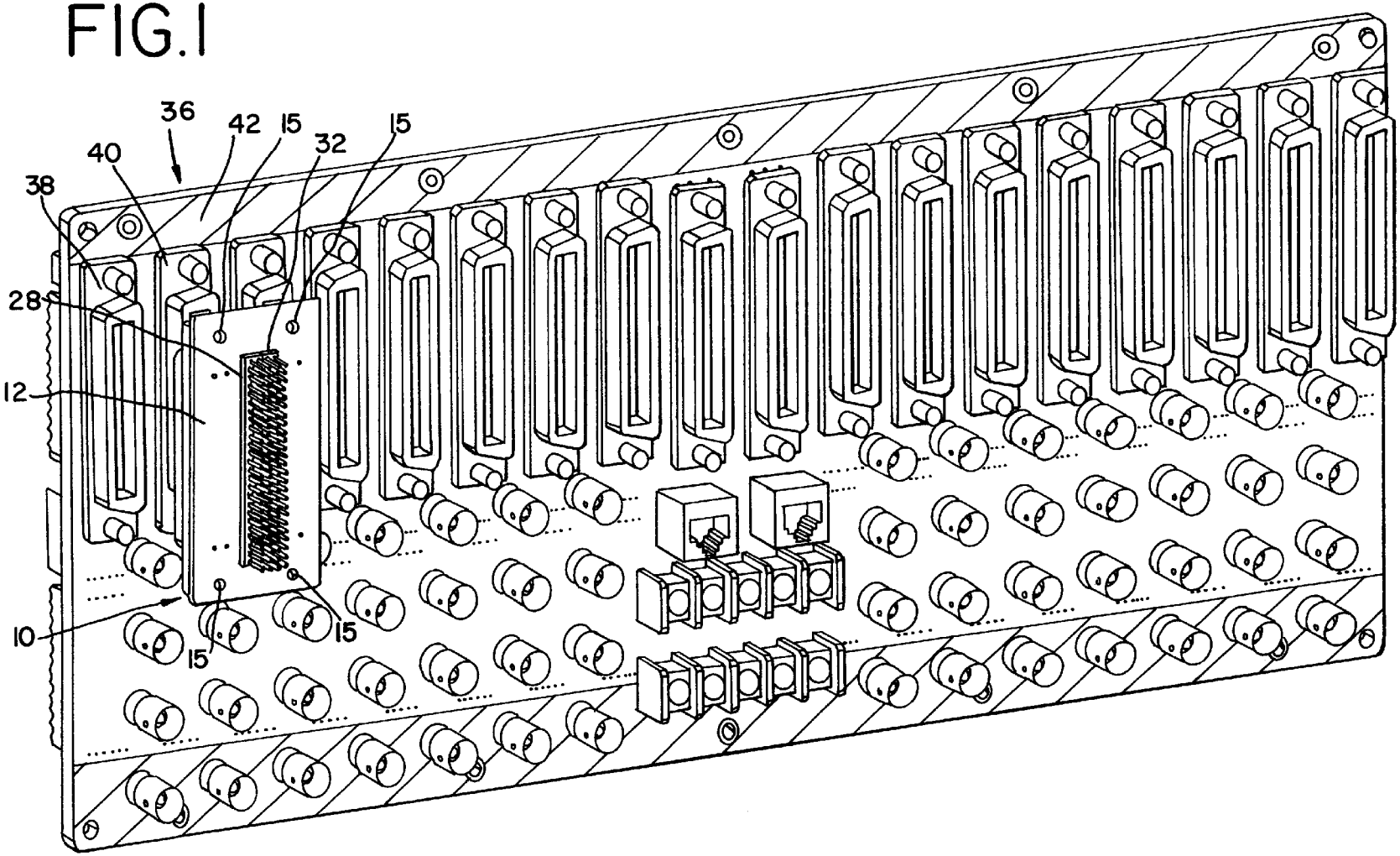
FIG. 1 is an exploded perspective view showing a backplane circuit board and a preferred embodiment of an adapter apparatus made in accordance with the invention.

Referring to FIGS. 1–5, a preferred embodiment of an adapter apparatus is generally shown at 10, and includes a circuit board 12 having a first side 14 and a second side 16. As shown in FIGS. 1–5, the circuit board 12 may preferably be a generally planar member, and may preferably be any of the conventional printed circuit boards suitable for supporting a variety of electronic components. The circuit board 12 may preferably be comprised of FR-4 fiberglass, and may preferably be 1.8 inches wide and 3.5 inches in length, although alternative sizes and configurations are contemplated. As shown in FIG. 1, the circuit board 14 may also preferably include a plurality of openings 15 to allow the adapter apparatus 10 to be attached to a housing (not shown).

Figure 2:
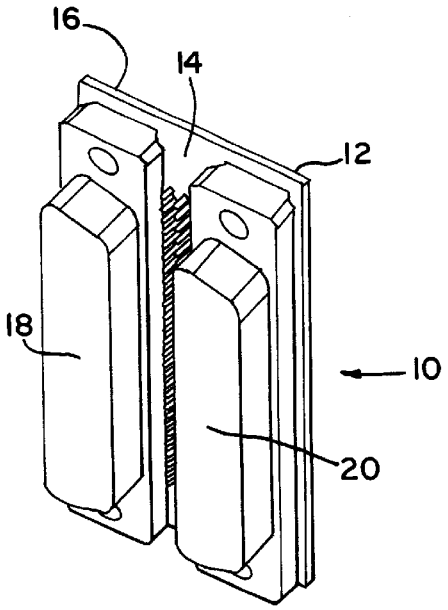
FIG. 2 is a perspective back view of the adapter apparatus of FIG. 1.
Figure 3:
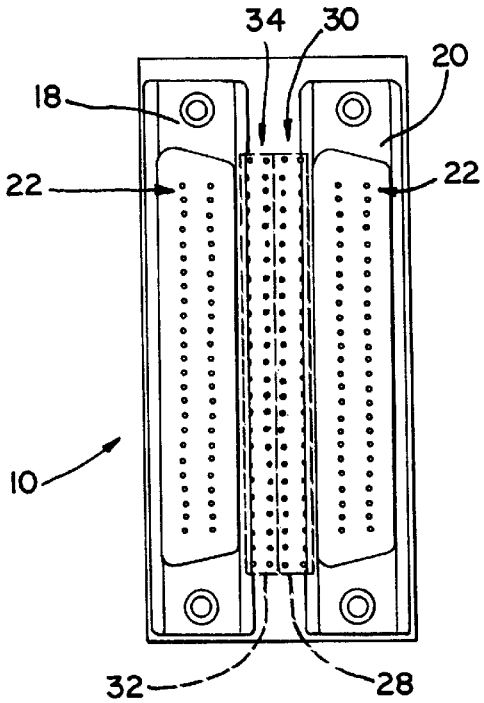
FIG. 3 is a plan view of the adapter apparatus of FIG. 2.
Figure 4:
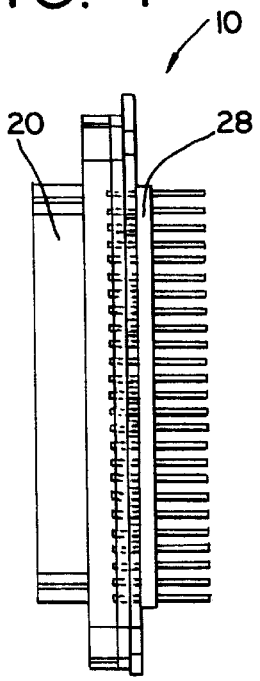
FIG. 4 is a side view of the embodiment of FIG. 3.
Figure 5:
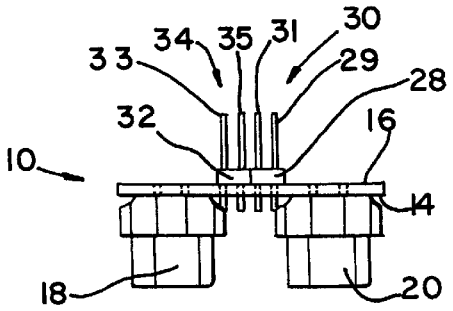
FIG. 5 is an end view of the embodiment of FIG. 3.

As shown in FIGS. 2, 3 and 5, at least two male connectors 18, 20 are positioned adjacent to the first side 14 of the circuit board 12. Each of the two male connectors 18, 20 includes a plurality of transmit-receive pairs of pins 22. Each of the plurality of transmit-receive pairs of pins 22 includes a pin for transmitting data and a pin for receiving data. In the embodiment shown, the plurality of transmit-receive pairs of pins 22 of the two male connectors 18, 20 include 25 pairs. The two male connectors 18, 20 may preferably be conventional centronics connectors.

As shown in FIGS. 1, 3, and 5, a first pin header 28 is positioned adjacent the second side 16 of the circuit board 12. The first pin header 28 includes a plurality of pins 30 for receiving data. A second pin header 32 is positioned adjacent the second side 16 of the circuit board 14 for transmitting data. The second pin header 32 includes a plurality of pins 34 for transmitting data. The plurality of pins 30 for receiving data and the plurality of pins 34 for transmitting data are operatively connected to the plurality of transmit-receive pairs of pins 22 of each of the two male connectors 18, 20. As shown in FIGS. 1, 3 and 5, the first and second pin headers 28, 32 may preferably be positioned adjacent to one another. The plurality of pins 30 of the first pin header 28 are aligned in a first row 29 and a second row 31. The plurality of pins 30 comprises 50 pins. Similarly, the plurality of pins 34 of the second pin header 32 are aligned in a first row 33 and a second row 35. The plurality of pins 34 comprises 50 pins. It is contemplated that the adapter apparatus 10 may be configured so that the plurality of pins 30 of the first pin header 28 may transmit data and the plurality of pins 34 of the second pin header 32 may receive data.

As shown in FIG. 1, a backplane circuit board 36 may preferably include at least two female connectors 38, 40 operatively connected to a first side 42 of the backplane circuit board 36. The backplane circuit board 36 may preferably be a generally planar member and may preferably be any of the conventional printed circuit boards suitable for supporting a variety of electronic components. In the embodiment shown, the female connectors 38, 40 are configured to mate with the male connectors 18, 20 of the adapter apparatus 10. As a result, each of the female connectors 38, 40 may preferably include a plurality of transmit-receive pairs of pins, each of the plurality of transmit-receive pairs of pins including a pin for transmitting data and a pin for receiving data. The plurality of transmit-receive pairs of pins of the two female connectors 38, 40 may preferably include 25 pairs. The two female connectors 38, 40 may preferably be conventional female centronics connectors.

During the installation process, the two male connectors 18, 20 of the adapter apparatus 10 may preferably be aligned with at least two female connectors 38, 40 mounted on the backplane circuit board 36. The two male connectors 18, 20 may preferably be connected to the two female connectors 38, 40. One advantage of the adapter apparatus 10 is that it allows input cables that have connectors (not shown) which are not compatible with the female connectors 38, 40 to be easily and quickly connected to the backplane circuit board 36 via the first and second pin headers 28, 32. For example, if one input cable contains 50 wires for transmitting data and another input cable contains 50 wires for receiving data, both of the cables can be stripped to expose the wires within the cable. The 50 receiving wires may preferably be attached to the pins of the first pin header 28. Similarly, the 50 transmitting wires may preferably be attached to the pins of the second pin header 32. The adapter apparatus 10 automatically routes the electrical signals from the first and second pin headers 28, 32 to the 25 transmit-receive pairs of pins 22 of each of the male connectors 18, 20, which in turn are compatible with the female connectors 38, 40. Moreover, the fact that all of the pins of the first pin header 28 are dedicated for either transmitting data or receiving data, and the pins of the second pin header are dedicated for either transmitting data or receiving data prevents a user from inadvertently crossing receiving wires and transmitting wires during installation.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An adapter apparatus for transmitting electronic data comprising:

a circuit board including a first side and a second side, a first male connector mounted to the first side of the circuit board, the first male connector including a plurality of pins, the plurality of pins of the first male connector including a first row of pin for transmitting data and a second row of pins for receiving data, the plurality of pins of the first male connector electrically connected to the circuit board, a second male connector mounted to the first side of the circuit board, the second male connector including a plurality of pins, the plurality of pins of the second male connector including a first row of pins for transmitting data and a second row of pins for receiving data, the plurality of pins of the second male connector electrically connected to the circuit board, a first pin header mounted to the second side of the circuit board, the first pin header including a plurality of pins, the plurality of pins of the first pin header electrically connected via the circuit board to the first row of pins of the first male connector and the first row of pins of the second male connector, the plurality of pins of the first pin header including an exposed conductive tail portion extending outward from the second side of the circuit board to allow a plurality of wires to be hardwired to the exposed conductive tail portion of the plurality of pins of the first pin header, a second pin header mounted to the second side of the circuit board, the second pin header including a plurality of pins, the plurality of pins of the second pin header electrically connected via the circuit board to the second row of pins the first male connector and the second row of pins of the second male connector, the plurality of pins of the second pin header including an exposed conductive tail portion extending outward from the second side of the circuit board to allow a plurality of wires to be hardwired to the exposed conductive tail portion of the plurality of pins of the second pin header.

2. The apparatus of claim 1 wherein the first pin header is positioned adjacent to the second pin header.

3. The apparatus of claim 1 wherein the plurality of pins of the first pin header are aligned in a first row and a second row.

4. The apparatus of claim 1 wherein the plurality of pins of the first pin header comprises 50 pins.

5. The apparatus of claim 1 wherein the plurality of pins of the second pin header are aligned in a first row and a second row.

6. The apparatus of claim 1 wherein the plurality of pins of the second pin header comprises 50 pins.

7. The apparatus of claim 1 wherein the first row of pins of the first male connector comprises 25 pins and the second row of pins of the first male connector comprises 25 pins.

8. The apparatus of claim 1 wherein the first row of pins of the second male connector comprises 25 pins and the second row of pins of the second male connector comprises 25 pins.

9. The apparatus of claim 1 wherein the circuit board includes a plurality of openings to allow the adapter apparatus to be attached to a housing.

10. The apparatus of claim 1 further comprising a backplane circuit board, each of the first and second male connectors operatively connected to the backplane circuit board.

11. The apparatus of claim 10 further comprising first and second female connectors operatively connected to a first side of the backplane circuit board, the first and second male connectors operatively connected to the first and second female connectors.

12. The apparatus of claim 11 wherein each of the first and second female connectors include a first row of pins for transmitting data and a second row of pins for receiving data.

13. The apparatus of claim 12 wherein the first row of pins comprises 25 pins and the second row of pins comprises 25 pins.

14. The apparatus of claim 11 wherein the first female connector is positioned adjacent to the second female connector.

15. A method of transmitting electronic data comprising the steps of:

providing a circuit board including a first side and a second side, a first male connector mounted to the first side of the circuit board, the first male connector including a plurality of pins, the plurality of pins of the first male connector including a first row of pins for transmitting data and a second row of pins for receiving data, a second male connector mounted to the first side of the circuit board, the second male connector including a plurality of pins, the plurality of pins of the second male connector including a first row of pins for transmitting data and a second row of pins for receiving data, a first pin header mounted to the second side of the circuit board, the first pin header including a plurality of pins, the plurality of pins of the first pin header including an exposed conductive tail portion extending outward from the second side of the circuit board, a second pin header mounted to the second side of the circuit board, the second pin header including a plurality of pins, the plurality of pins of the second pin header including an exposed conductive tail portion extending outward from the second side of the circuit board;

electrically connecting the plurality of pins of the first male connector to the circuit board;

electrically connecting the plurality of pins of the second male connector to the circuit board;

electrically connecting via the circuit board the plurality of pins of the first pin header to the first row of pins of the first male connector and the first row of pins of the second male connector; and electrically connecting the plurality of pins of the second pin header to the second row of pins of the first male connector and the second row of pins of the second male connector.

16. The method of claim 15 further comprising the steps of:

hardwiring a plurality of wires to the exposed conductive tail potion of the plurality of pins of the first pin header.

17. The method of claim 15 further comprising the steps of:

hardwiring a plurality of wires to the exposed conductive tail portion of the plurality of pins of the second pin header.

18. The method of claim 15 further comprising the steps of:

providing a backplane circuit board, first and second female connectors operatively connected to a first side of the backplane circuit board; and electrically connecting the first and second male connectors to the first and second female connectors.

* * * * *

UNITED STATES PATENT AND TRADEMARK OFFICE

CERTIFICATE OF CORRECTION

PATENT NO. : 6,146,153
DATED : November 14, 2000
INVENTOR(S) : Amir Koradia, Philip A. Ravlin and John J. Connell It is certified that error appears in the above-identified patent and that said Letters Patent is hereby corrected as shown below:

Title page,
Item [22], please change the Filing Date from "March 3, 1999" to -- March 9, 1999 --.

Claim 1,
Line 46, please change the word "pin" to -- pins --.

Signed and Sealed this

Twenty-fifth Day of December, 2001

*Attest:*

*Attesting Officer*

JAMES E. ROGAN
*Director of the United States Patent and Trademark Office*